US005497902A

United States Patent [19]

Crock

[11] Patent Number: 5,497,902

[45] Date of Patent: Mar. 12, 1996

[54] THERMALLY INSULATED BEVERAGE MUG WITH DETACHABLE POUCH

[76] Inventor: Gary H. Crock, 65 Bond Cres., Richmond Hill, Ontario, Canada, L4E-3K6

[21] Appl. No.: 335,944

[22] Filed: Nov. 8, 1994

[51] Int. Cl.[6] ..... B65D 25/18

[52] U.S. Cl. ..... 220/737; 220/739; 220/23.4

[58] Field of Search ..... 220/737, 738, 220/739, 23.4, 23.86

[56] References Cited

U.S. PATENT DOCUMENTS

| | | | |
|---|---|---|---|
| 2,719,414 | 10/1955 | Davis | 220/738 |
| 4,345,704 | 8/1982 | Boughton | 220/737 |
| 4,491,220 | 1/1985 | Daviss | 220/737 |
| 4,552,276 | 11/1985 | Buch | 220/737 |
| 4,746,028 | 5/1988 | Bagg | 220/739 |
| 4,860,896 | 8/1989 | Snider | 220/737 |
| 5,186,350 | 2/1993 | McBride | 220/739 |
| 5,381,922 | 1/1995 | Gladman et al. | 220/737 |

*Primary Examiner*—Joseph M. Moy

[57] ABSTRACT

A thermally insulated beverage mug with detachable pouch comprising a shell having a bottom wall, a tubular side wall coupled to the bottom wall and extended upwards therefrom to define a hollow interior and an opening for allowing access thereto; an insulating liner having a bottom wall, a tubular side wall coupled to the bottom wall and extended upwards therefrom to define a hollow interior adapted for receiving a beverage can and an opening for allowing access thereto for placing the beverage can therein and with the liner disposed within the interior of the shell; a handle for allowing a user a rim grip; a handle coupling mechanism for removably coupling the handle to the shell; a pouch for holding miscellaneous items therein; and a pouch coupling mechanism for removably coupling the pouch to the shell.

6 Claims, 3 Drawing Sheets

FIG. 5
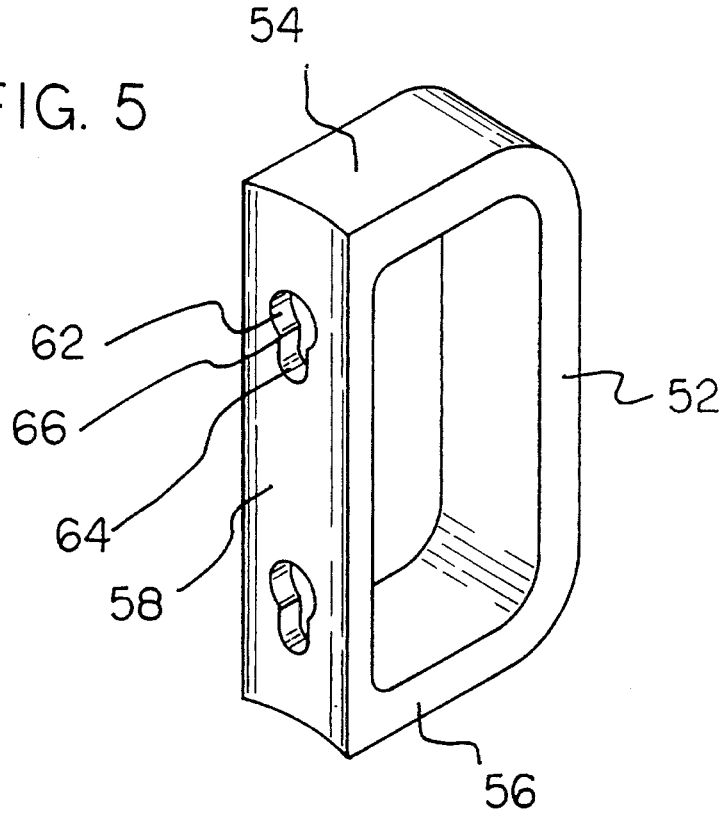
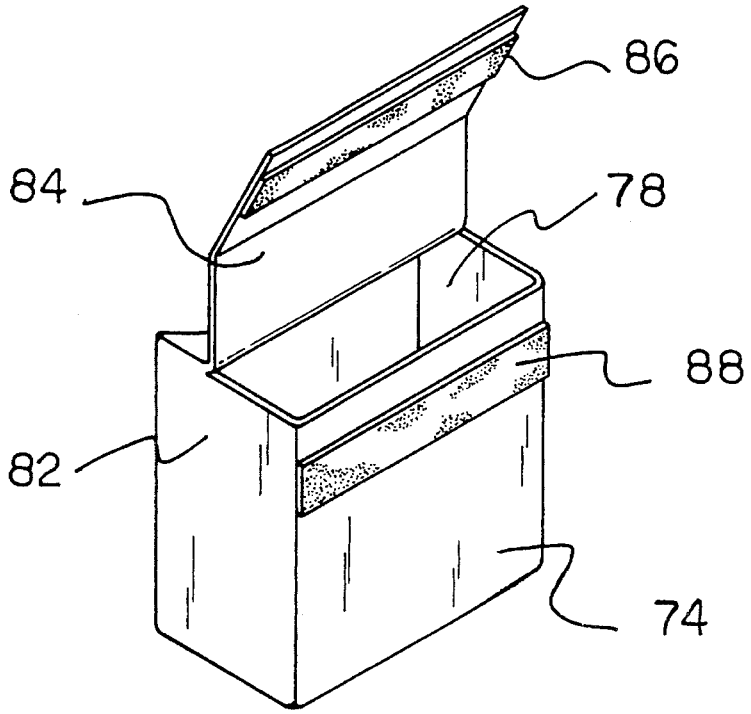
FIG. 6

THERMALLY INSULATED BEVERAGE MUG WITH DETACHABLE POUCH

BACKGROUND OF THE INVENTION

1. Field of the Invention

The present invention relates to a thermally insulated beverage mug with detachable pouch and more particularly pertains to holding a standard-sized beverage can while simultaneously holding items such as money, keys, cigarettes and the like in an adjacent location with a thermally insulated beverage mug with detachable pouch.

2. Description of the Prior Art

The use of beverage mugs is known in the prior art. More specifically, beverage mugs heretofore devised and utilized for the purpose of holding beverages are known to consist basically of familiar, expected and obvious structural configurations, notwithstanding the myriad of designs encompassed by the crowded prior art which have been developed for the fulfillment of countless objectives and requirements.

By way of example, U.S. Pat. Des. 245,161 to Perkins discloses a beer mug chiller. U.S. Pat. Des. 306,546 to Coy discloses a combined insulated beverage and pouch. U.S. Pat. Des. 323,853 to Evenson discloses a combined pencil cup and holder for assorted desk articles. Gerhards U.S. Pat. No. 4,555,034 discloses a beer mug. Fierthaler U.S. Pat. No. 4,984,707 discloses a thermally insulated beverage mug.

While these devices fulfill their respective, particular objective and requirements, the aforementioned patents do not describe a thermally insulated beverage mug with detachable pouch that includes a mug that is adapted for holding a standard-sized beverage can therein while simultaneously holding miscellaneous items in an adjacent pouch for ready access.

In this respect, the thermally insulated beverage mug with detachable pouch according to the present invention substantially departs from the conventional concepts and designs of the prior art, and in doing so provides an apparatus primarily developed for the purpose of holding a standard-sized beverage can while simultaneously holding items such as money, keys, cigarettes and the like in an adjacent location.

Therefore, it can be appreciated that there exists a continuing need for new and improved thermally insulated beverage mug with detachable pouch which can be used for holding a standard-sized beverage can while simultaneously holding items such as money, keys, cigarettes and the like in an adjacent location. In this regard, the present invention substantially fulfills this need.

SUMMARY OF THE INVENTION

In the view of the foregoing disadvantages inherent in the known types of beverage mugs now present in the prior art, the present invention provides an improved thermally insulated beverage mug with detachable pouch. As such, the general purpose of the present invention, which will be described subsequently in greater detail, is to provide a new and improved thermally insulated beverage mug with detachable pouch and method which has all the advantages of the prior art and none of the disadvantages.

To attain this, the present invention essentially comprises, in combination, a shell having a circular bottom wall, a tubular side wall coupled to the bottom wall and extended upwards therefrom to define a cylindrical hollow interior and an opening for allowing access thereto and wherein the external diameter of the shell is between about 35% to about 40% greater than its axial length, and a pair of spaced and vertically aligned pins each having a shaft extended outwards from the side wall and terminated at a head. An insulating liner is included and has a circular bottom wall, a tubular side wall coupled to the bottom wall and extended upwards therefrom to define a hollow cylindrical interior having a diameter of 2.6 inches+—10% such that it is adapted for receiving a standard-sized beverage can and an opening for allowing access thereto for placing the beverage can therein and with the liner disposed within the interior of the shell such that their openings are generally aligned. A rigid plastic handle is included and has a vertical u-shaped exterior segment with a top end and a bottom end, an interior segment integrally coupled between the top end and bottom end of the exterior segment and with the interior segment shaped to conform with the side wall of the shell, a pair of spaced slots disposed along the interior segment of the handle at a location alignable with the pins on the shell with each slot having an upper portion, a lower portion, and a retracted portion therebetween and with the handle positionable upon the pins of the shell when the shafts of the pins are placed within the upper portions of the slots and with the handle further securable to the shell when the shafts of the pins are positioned within the lower portion of the slot. A pouch is included and has a back wall shaped to conform with the side wall of the shell, a front wall offset from the back wall, a periphery interconnecting the back wall with the front wall to define a hollow interior and an opening for allowing access to the interior and with the periphery formed of a bottom wall and two opposed and spaced side walls, an integral lid coupled to the back wall and side walls with a portion thereof pivotable for allowing access to the interior in one orientation and preventing access to the interior in another orientation, a strip of pile type fastener secured to the lid, and a strip of complimentary pile type fastener secured to the front wall and with the pile type fasteners coupleable together for securing the lid over the opening. A pouch coupling mechanism is included for removably coupling the pouch at a selected location on the periphery of the shell with the pouch coupling mechanism having two spaced horizontal elongated strips of pile type fastener coupled to and wrapped around the side wall of the shell such that their ends are positioned on each side of a pin and two spaced horizontal strips of complementary pile type fastener coupled to the back wall of the pouch at locations alignable with and securable to the strips on the shell.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measuredly the claims, nor is it intended to be limiting as to the scope of the invention in any way.

It is therefore an object of the present invention to provide a new and improved thermally insulated beverage mug with detachable pouch which has all the advantages of the prior art beverage mugs and none of the disadvantages.

It is another object of the present invention to provide a new and improved thermally insulated beverage mug with detachable pouch which may be easily and efficiently manufactured and marketed.

It is a further object of the present invention to provide a new and improved themally insulated beverage mug with detachable pouch which is of durable and reliable construction.

An even further object of the present invention is to provide a new and improved themally insulated beverage mug with detachable pouch which is susceptible of a low cost of manufacture with regard to both materials and labor, and which accordingly is then susceptible of low prices of sale to the consuming public, thereby making such a thermally insulated beverage mug with detachable pouch economically available to the buying public.

Still yet another object of the present invention is to provide a new and improved thermally insulated beverage mug with detachable pouch which provides in the apparatuses and methods of the prior art some of the advantages thereof, while simultaneously overcoming some of the disadvantages normally associated therewith.

Even still another object of the present invention is to provide a new and improved thermally insulated beverage mug with detachable pouch for holding a standard-sized beverage can while simultaneously holding items such as money, keys, cigarettes and the like in an adjacent location.

Lastly, it is an object of the present invention to provide a new and improved thermally insulated beverage mug with detachable pouch comprising a shell having a bottom wall, a tubular side wall coupled to the bottom wall and extended upwards therefrom to define a hollow interior and an opening for allowing access thereto; an insulating liner having a bottom wall, a tubular side wall coupled to the bottom wall and extended upwards therefrom to define a hollow interior adapted for receiving a beverage can and an opening for allowing access thereto for placing the beverage can therein and with the liner disposed within the interior of the shell; a handle; handle coupling means for removably coupling the handle to the shell; a pouch; and pouch coupling means for removably coupling the pouch to the shell.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective view of the handle of the present invention.

FIG. 6 is a perspective view of the pouch of the present invention.

The same reference numerals refer to the same parts through the various Figures.

DESCRIPTION OF THE PREFERRED EMBODIMENT

Figure 1:
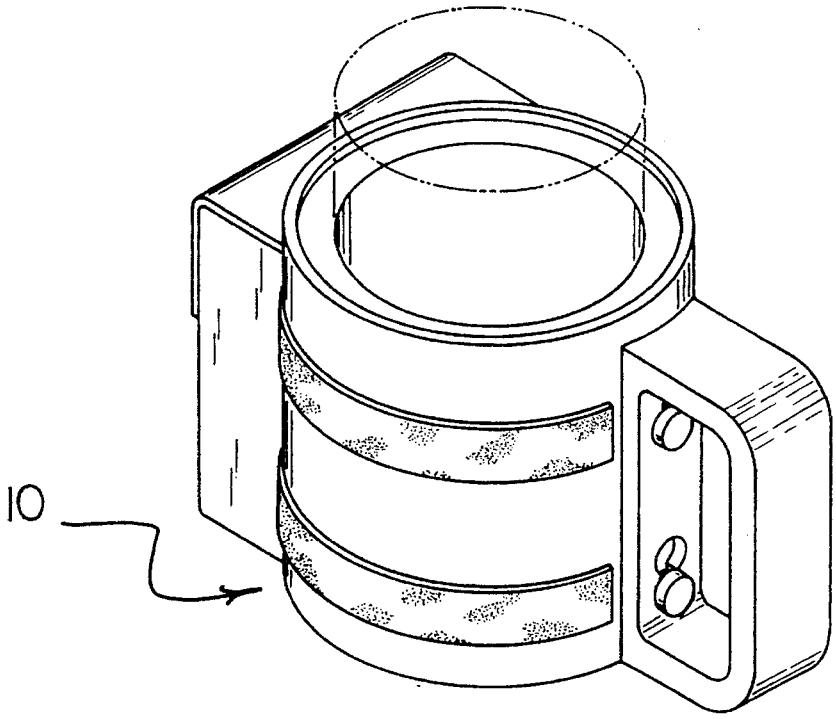
FIG. 1 is a perspective view of the preferred embodiment constructed in accordance with the principles of the present invention secured about a standard-sized beverage can.
Figure 2:
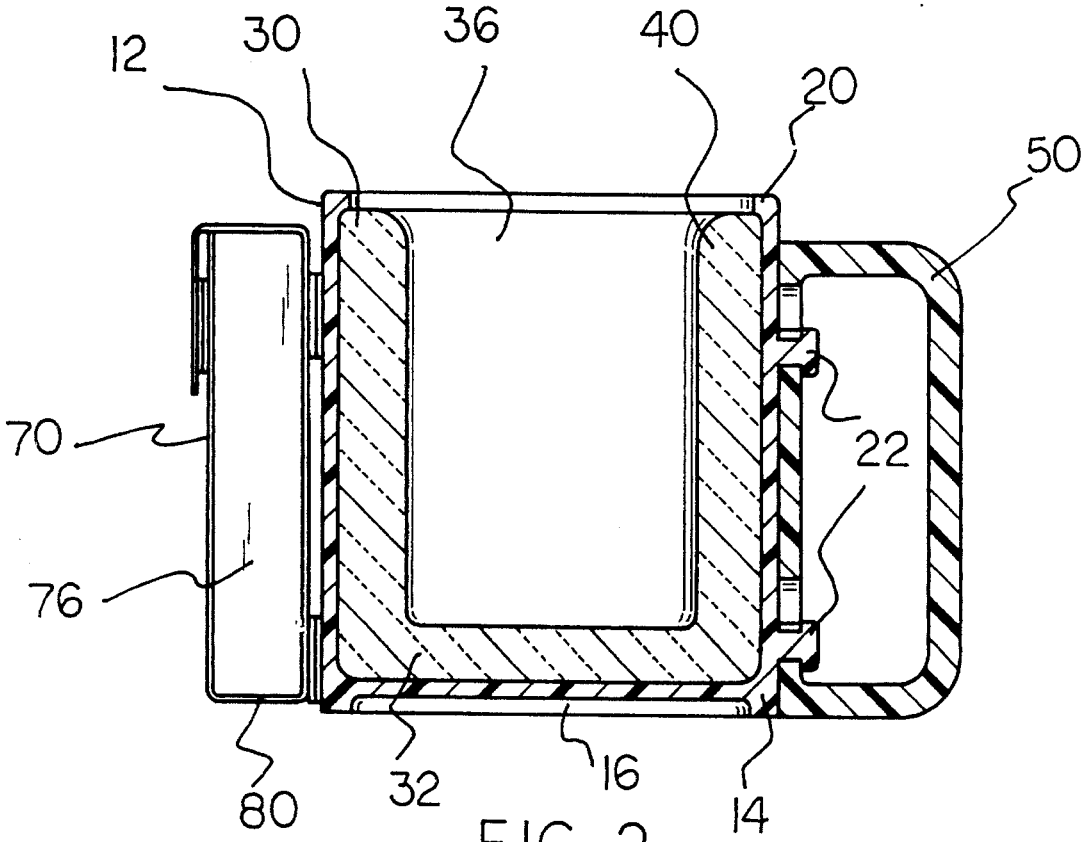
FIG. 2 is a side cross-sectional view of the present invention.
Figure 3:
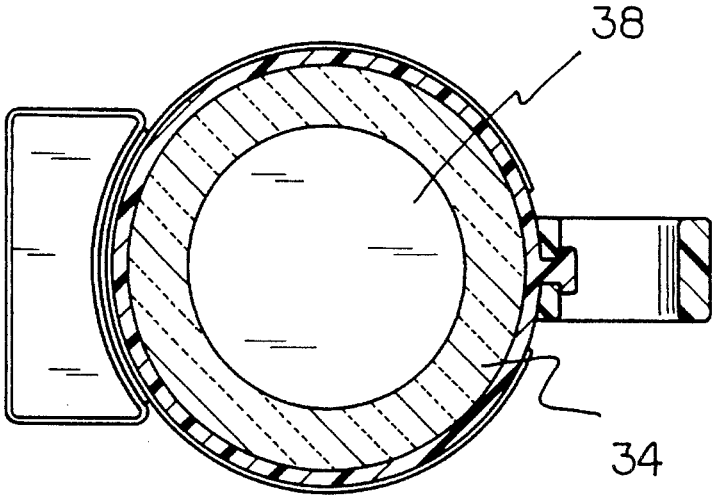
FIG. 3 is a top cross-sectional view of the present invention.
Figure 4:
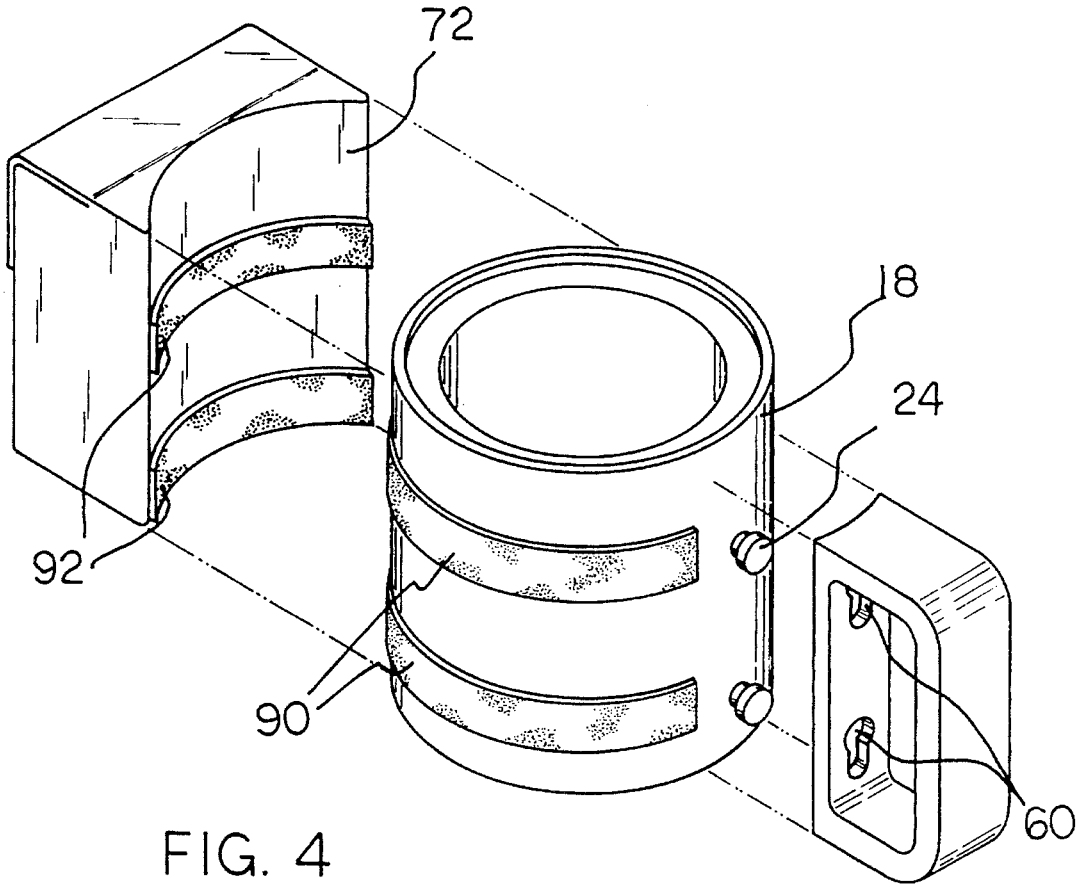
FIG. 4 is an exploded perspective view of the present invention.

With reference now to the drawings, and in particular, to FIG. 1 thereof, the preferred embodiment of the new and improved thermally insulated beverage mug with detachable pouch embodying the principles and concepts of the present invention and generally designated by the reference number 10 will be described.

Specifically, the present invention includes five major components. The major components are the shell, liner, handle, pouch, and pouch coupling mechanism. These components are interrelated to provide the intended function of holding a standard-size beverage can while simultaneously holding items such as money, keys, cigarettes and the like in an adjacent location.

More specifically, it will be noted in the various Figures that the first major component is the shell 12. The shell is formed of plastic and is rigid in structure. The shell has a circular bottom wall 14 with a recessed lower surface 16. The shell also has a tubular side wall 18 coupled to the bottom wall and extended upwards therefrom to define a cylindrical hollow interior and an opening for allowing access to the interior. The side wall is terminated at an inwardly extended radial lip 20 near the opening. In the preferred embodiment, the axial length of the shell is about 5 inches and its external diameter is about 8 inches. Thus, its diameter is about 60 percent greater than its axial length. The shell also includes a pair of spaced and vertically aligned pins 22. Each pin has a shaft extended outwards from the side wall and is terminated at a head 24.

The second major component is the liner 30. The liner is formed of an insulated foam plastic material. The liner is used for thermally insulating a beverage can disposed therein. The liner has a circular bottom wall 32 and a tubular side wall 34 coupled to the bottom wall and extended upwards therefrom to define a hollow cylindrical interior 36 and an opening 38 for allowing access to the interior for placing the beverage can therein. The cylindrical interior has a diameter of about 2.6 inches, which is about the diameter of a commercially available standard-sized beverage can. The opening to the interior tapers outwards near the top end to form a rounded edge 40 on the adjacent side wall of the liner. The liner is disposed within the interior of the shell such that the bottom wall is placed in contact with the bottom wall of the shell, the side walls are placed in contact with the side walls of the shell, and the openings of the shell and liner are generally aligned.

The third major component is the handle 50. The handle is rigid in structure and formed of a plastic material. The handle has a vertical u-shaped exterior segment 52 with a top end 54 and a bottom end 56. The handle also includes an interior segment 58 integrally coupled between the top end and bottom end of the exterior segment. The interior segment is shaped to conform with the side wall 18 of the shell. The handle also includes a pair of spaced slots 60. Each slot is disposed along the interior segment of the handle at a location alignable with a pin 22 on the shell. Each slot has an upper portion 62, a lower portion 64, and a retracted portion 66 therebetween. The handle is positionable upon the pins of the shell when the shafts are placed within the upper portions of the slots. The handle is securable to the shell when the shafts of the pins are positioned within the lower portions of the slots when the handle is pressed downwards. In this secured configuration, the pins are held within the lower portions of the slots by the retracted portion and the interior segment of the handle is secured between the heads of the pins and the side wall of the shell. The handle is releasable from the shell when the shell is held in a fixed position and the handle is lifted upwards. Other conventional coupling mechanisms may be utilized for removably securing the handle to the shell such as adhesive, snaps, clips, or screws.

The fourth major component is the pouch 70. The pouch has a back wall 72 shaped to conform with the side wall 18 of the shell. The pouch also has a front wall 74 offset from the back wall. A periphery interconnects the back wall with the front wall to define a hollow interior 76 and an opening 78 for allowing access to the interior. Money, keys, cigarettes, and the like may be disposed through the opening of the pouch and held within the interior for ready access. The periphery of the pouch is formed of a bottom wall 80 and two opposed and spaced side walls 82. The pouch also includes an integral lid 84 coupled to the back wall and side walls with a portion thereof pivotable for allowing access to the interior in one orientation and preventing access to the interior in another orientation. A strip of pile type fastener 86 is secured to the lid. A strip of complimentary pile type fastener 88 is secured to the front wall. The pile type fasteners are coupleable together for securing the lid over the opening and thereby preventing access to the interior. The back wall of the pouch has a height less than the axial length of the side wall of the shell. The back wall has a width less than the circumference of the shell as measured along its contour. The pouch does not extend downwards past the bottom wall of the shell. Likewise, the lid of the pouch in its secured position does not extend above the top opening of the shell.

The fifth major component is the pouch coupling mechanism. The pouch coupling mechanism is used for removably coupling the pouch at a selected location along the periphery of the shell. This allows the pouch to placed at a peripheral location as desired by a user for ready access thereto. The coupling mechanism includes two spaced horizontal elongated strips 90 of pile type fastener coupled to and wrapped around the side wall 18 of the shell. The ends of the strips of pile type fastener are positioned on each side of a pin 24. Furthermore, two spaced horizontal strips of complimentary pile type fastener 92 are coupled to the back wall 72 of the pouch at locations alignable with an securable to the strips on the shell. The strips of pile type fastener are removably coupleable to the strips of complementary pile type fastener for securing the back wall of the pouch to the sidewall of the shell. Other conventional coupling mechanisms may be utilized for removably securing the pouch to the shell such as adhesive, snaps, clips, or screws.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A thermally insulated beverage mug with detachable pouch for holding a standard-sized beverage can while simultaneously holding items such as money, keys, cigarettes and the like in an adjacent location comprising, in combination:

a shell having a circular bottom wall, a tubular side wall coupled to the bottom wall and extended upwards therefrom to define a cylindrical hollow interior and an opening for allowing access thereto and wherein the external diameter of the shell is between about (60+—10)% greater than its axial length, and a pair of spaced and vertically aligned pins each having a shaft extended outwards from the side wall and terminated at a head;

an insulating liner having a circular bottom wall, a tubular side wall coupled to the bottom wall and extended upwards therefrom to define a hollow cylindrical interior having a diameter of 2.6 inches+—10% such that it is adapted for receiving a standard-sized beverage can and an opening for allowing access thereto for placing the beverage can therein and with the liner disposed within the interior of the shell such that their openings are generally aligned;

a rigid plastic handle having a vertical u-shaped exterior segment with a top end and a bottom end, an interior segment integrally coupled between the top end and bottom end of the exterior segment and with the interior segment shaped to conform with the side wall of the shell, a pair of spaced slots disposed along the interior segment of the handle at a location alignable with the pins on the shell, each slot having an upper portion, a lower portion, and a retracted portion therebetween and with the handle positionable upon the pins of the shell when the shafts of the pins are placed within the upper portions of the slots, and with the handle securable to the shell when the shafts of the pins are positioned within the lower portion of the slot;

a pouch having a back wall shaped to conform with the side wall of the shell, a front wall offset from the back wall, a periphery interconnecting the back wall with the front wall to define a hollow interior and an opening for allowing access to the interior and with the periphery formed of a bottom wall and two opposed and spaced side walls, an integral lid coupled to the back wall and side walls with a portion thereof pivotable for allowing access to the interior in one orientation and preventing access to the interior in another orientation, a strip of pile type fastener secured to the lid, and a strip of complimentary pile type fastener secured to the front wall and with the pile type fasteners coupleable together for securing the lid over the opening; and a pouch coupling mechanism for removably coupling the pouch at a selected location on the periphery of the shell, the pouch coupling mechanism including two spaced horizontal elongated strips of pile type fastener coupled to and wrapped around the side wall of the shell and two spaced horizontal strips of complementary pile type fastener coupled to the back wall of the pouch at locations alignable with and securable to the strips on the shell.

2. A thermally insulated beverage mug with detachable pouch comprising:

a shell having a bottom wall, a tubular side wall coupled to the bottom wall and extended upwards therefrom to define a hollow interior and an opening for allowing access thereto;

an insulating liner having a bottom wall, a tubular side wall coupled to the bottom wall and extended upwards therefrom to define a hollow interior adapted for receiving a beverage can and an opening for allowing access thereto for placing the beverage can therein and with the liner disposed within the interior of the shell;

a handle;

handle coupling means for removably coupling the handle to the shell;

a pouch; and pouch coupling means for removably coupling the pouch to the shell.

3. The thermally insulated beverage mug with detachable pouch as set forth in claim 2 wherein the external diameter of the shell is (60+−5)% greater than its axial length.

4. The thermally insulated beverage mug with detachable pouch as set forth in claim 2 wherein the interior of the liner is cylindrical and has a diameter of 2.6 inches+−10%.

5. The thermally insulated beverage mug with detachable pouch as set forth in claim 2 wherein the handle coupling means comprises at least one pin extended from the shell and at least one slot formed on the handle with the pin securable within the slot.

6. The thermally insulated beverage mug with detachable pouch as set forth in claim 2 wherein the pouch coupling means is a fastener of the pile type.

* * * * *